US005994839A

United States Patent [19]

Yamamoto et al.

[11] Patent Number: 5,994,839

[45] Date of Patent: Nov. 30, 1999

[54] HIGH-PRESSURE METAL VAPOR DISCHARGE LAMP

[75] Inventors: Takashi Yamamoto, Takatsuki; Shiki Nakayama, Ibaraki; Hiroshi Nohara, Nara; Yoshiharu Nishiura, Otsu; Shigefumi Oda, Higashiosaka, all of Japan

[73] Assignee: Matsushita Electronics Corporation, Osaka-Fu, Japan

[21] Appl. No.: 08/937,945

[22] Filed: Sep. 25, 1997

[30] Foreign Application Priority Data

Oct. 30, 1996 [JP] Japan ..... 8-262658

[51] Int. Cl.[6] ..... H01J 61/30

[52] U.S. Cl. ..... 313/570; 313/623; 313/25

[58] Field of Search ..... 313/570, 623, 313/624, 625, 25

[56] References Cited

U.S. PATENT DOCUMENTS

| | | | |
|---|---|---|---|
| 5,424,609 | 6/1995 | Geven et al. | 313/623 |
| 5,557,169 | 9/1996 | Van Lierop et al. | 313/623 |
| 5,661,367 | 8/1997 | Fellows et al. | 313/623 |
| 5,742,124 | 4/1998 | Kees et al. | 313/625 |
| 5,866,982 | 2/1999 | Scott et al. | 313/623 |

FOREIGN PATENT DOCUMENTS

| | | |
|---|---|---|
| 0 587 238 A1 | 3/1994 | European Pat. Off. . |
| 51-55179 | 5/1976 | Japan . |

*Primary Examiner*—Ashok Patel

*Attorney, Agent, or Firm*—Akin, Gump, Strauss, Hauer & Feld, L.L.P.

[57] ABSTRACT

A high-pressure metal vapor discharge lamp of the present invention has a discharge tube made of a ceramic material having a transparent or translucent property, and the discharge tube has a main tube, and a first and a second disks for sealing the main tube. The first disk is disposed at one opening of said main tube, and the second disk disposed at the other opening of said main tube. Further, the first and the second disks have a cylindrical narrow tube. A lead-through-part for disposing either of a first and a second main electrodes and an auxiliary electrode in the main tube and a sealing member integrated with the lead-through-wire are inserted in the cylindrical narrow tube, and the sealing member is fixed to the cylindrical narrow tube so that the cylindrical narrow tube is sealed airtightly.

16 Claims, 12 Drawing Sheets

HIGH-PRESSURE METAL VAPOR DISCHARGE LAMP

BACKGROUND OF THE INVENTION

The present invention relates to a high-pressure metal vapor discharge lamp comprising a discharge tube made of a ceramic material having a transparent or translucent property.

A typical conventional high-pressure metal vapor discharge lamp will be explained with reference to FIG. 12.

FIG. 12 is a partially cross-sectional view showing a configuration of a conventional high-pressure metal vapor discharge lamp.

As shown in FIG. 12, a conventional high-pressure metal vapor discharge lamp comprises a discharge tube 51 contained in an outer tube 50, a pair of main electrodes 52*a*, 52*b* disposed inside the discharge tube 51, and an auxiliary electrode 53 disposed in the vicinity of the main electrode 52*b*. An external surface of the outer tube 50 is coated with a fluorocarbon resin film 50*a*. A mixture of Ne-gas and $N_2$-gas is filled in the outer tube 50. The main electrodes 52*a*, 52*b* comprises electrode rods 58*a*, 58*b* and electrode coils 61*a*, 61*b*, respectively.

The discharge tube 51 is made of quartz glass having a transparent or translucent property, and consists of a discharge part 54 for a discharge space and sealed parts 55*a*, 55*b* disposed at the both end parts of the discharge part 54, respectively. A metal halide as a luminescent material and a mixture of Ne-gas and Ar-gas or the like for a start of a lighting operation are filled into the discharge tube 51.

The sealed part 55*a* is mounted to one end part of the discharge part 54 together with a main electrode current supply conductor 56*a* for supplying a current to the electrode coil 61*a* by a pinch seal method. Similarly, the sealed part 55*b* is mounted to the other end part of the discharge part 54 together with a main electrode current supply conductor 56*b* and an auxiliary electrode current supply conductor 57 for supplying a current to the electrode coil 61*b* and the auxiliary electrode 53, respectively, by the pinch seal method.

The main electrode current supply conductor 56*a* is configured by integrating the electrode rod 58*a* which holds the main electrode 52*a* at one end, a molybdenum foil 59*a* connected to the other end of the electrode rod 58*a*, and an external lead wire 60*a* connected at one end of the molybdenum foil 59*a*. Similarly, the main electrode current supply conductor 56*b* is configured by integrating the electrode rod 58*b* which holds the main electrode 52*b* at one end, a molybdenum foil 59*b* connected to the other end of the electrode rod 58*b*, and an external lead wire 60*b* connected at one end of the molybdenum foil 59*b*. The auxiliary electrode-current supply conductor 57 is configured by integrating an electrode rod 58*c* which holds the auxiliary electrode 53 at one end, a molybdenum foil 59*c* connected to the other end of the electrode rod 58*c*, and an external lead wire 60*c* connected at one end of the molybdenum foil 59*c*.

In the lighting operation for the conventional high-pressure metal vapor discharge lamp, at first, an auxiliary discharge is generated between the main electrode 52*b* and the auxiliary electrode 53, and thereafter the auxiliary discharge is induced to a main discharge generated between the main electrodes 52*a* and 52*b*.

Particularly, a metal halide lamp, which is one of the conventional high-pressure metal vapor discharge lamps having the above-mentioned configuration, is widely used.

This is because a conventional stabilizer using in a mercury lamp is available as a power source of the metal halide lamp without modification.

However, in the conventional high-pressure metal vapor discharge lamp, as explained above, the sealed parts 55*a*, 55*b* are mounted to the both end parts of the discharge part 54 by the pinch seal method, respectively. Therefore, a shape of the discharge tube 51 is not always formed into uniform size and shape, i.e., it is difficult to make the discharge tube 51 into a constant shape in mass production. Furthermore, there occurs a problem that characteristics of the lamp are varied according to different shapes of the discharge tube 51.

Moreover, in the conventional high-pressure metal vapor discharge lamp, if the shapes of the sealed parts 55*a*, 55*b* are large, a heat loss from the discharge space of the discharge tube 51 is increased. This makes it difficult to achieve a sufficient efficiency and to obtain an excellent color rendering index. Furthermore, it is necessary to seal the molybdenum foil 59*b* for the main electrode 52*b* and the molybdenum foil 59*c* for the auxiliary electrode 53 into the sealed part 55*b* in such a manner that the molybdenum foils 59*b*, 59*c* are spaced apart from each other by a predetermined gap. Therefore, it is difficult to form the sealed part 55*b* into a small shape.

Furthermore, in the conventional high-pressure metal vapor discharge lamp, the Ne-gas filled in the discharge tube 51 permeates through the quartz glass of the discharge tube 51. Therefore, for the purpose of preventing permeation of the Ne-gas, it is necessary to fill the mixed gas containing the Ne-gas inside the outer tube 50. However, when the mixed gas containing the Ne-gas is filled inside the outer tube 50, temperature of an external wall of the discharge tube 51 is reduced by the mixed gas. Therefore, in order to obtain and maintain a desired temperature of the external wall of the discharge tube 51 in a steady state operating condition, it is necessary to increase discharge intensity of the main discharge inside the discharge tube 51 while suppressing deterioration of a lifetime characteristic as much as possible. Further, since the deterioration of the lifetime characteristic is caused by a chemical reaction between the quartz glass of an inner wall of the discharge tube 51 and the filled metal halide therein, it is strongly desired to suppress the chemical reaction between the filled metal halide and the quartz glass which is a material of the discharge tube 51.

Any conventional high-pressure metal vapor discharge lamps attempting to reduce scattering, deviations or dispersion in the shape of the discharge tube 51, there is a high-pressure sodium lamp as disclosed in unexamined and published Japanese patent application TOKKAI (SHO) No. 51-55179, for example. In this conventional high-pressure metal vapor discharge lamp, the discharge tube is made of a ceramic material, and a metal rod equipped with the main electrode is airtightly filled with a (glass) frit to a disk-shaped ceramic disk member which is disposed instead of the sealed parts. In this manner, this conventional lamp suppresses deviations in the shape of the discharge tube and attempts to improve quality of the lamp by means of a use of the ceramic material for the discharge tube.

However, in this conventional high-pressure metal vapor discharge lamp, the metal rod equipped with the main electrode is airtightly bonded to the disk-shaped ceramic disk member by the frit. Since coefficient of expansion of the metal rod is different from that of the ceramic disk member, there occurs a problem that the filled metal and the like leak from the discharge tube through gaps generated between the metal rod and the ceramic disk member during the lighting operation. Furthermore, a chemical reaction is generated between the frit and the filled metal. In the case of the metal halide lamp which uses the metal halide as the luminescent material in particular, when the frit is used at portions where temperature becomes high during the lighting operation (e.g., contact sections between the metal rod and the ceramic disk member inside the discharge tube), undesirable chemical reaction is generated intensively. As a result, the characteristics of the lamp are deteriorated, and further the lifetime of the lamp is shortened.

BRIEF SUMMARY OF THE INVENTION

The object of the present invention is to provide a high-pressure metal vapor discharge lamp that can solve the aforementioned problems.

In order to achieve the above-mentioned object, a high-pressure metal vapor discharge lamp comprises:

- a discharge tube made of a ceramic material having a transparent or translucent property, the discharge tube containing at least a luminescent material, and the discharge tube having a main tube, a first disk disposed at one opening of the main tube, and a second disk disposed at the other opening of the main tube,
- a plurality of a cylindrical narrow tube made of a ceramic material, the cylindrical narrow tube being mounted to the first and second disks,
- a plurality of a lead-through-part disposing a pair of main electrodes and an auxiliary electrode in the main tube, and
- a sealing member integrated with the lead-through-part, the sealing member being inserted in the cylindrical narrow tube so that the cylindrical narrow tube is sealed airtightly.

According to the present invention, the high-pressure metal vapor discharge lamp has the discharge tube made of the ceramic material instead of a conventional discharge tube made of a quarts glass. Thereby, it is possible to make the discharge tube into a constant shape easily, and to prevent deviations in a shape of the discharge tube in mass production. As a result, it is possible to reduce deviations in a lamp characteristic due to the deviations in the shape. Furthermore, a chemical reaction between the discharge tube and the filled material therein can be suppressed, and a change in the lamp characteristic can be reduced during a lifetime of the lamp. Moreover, it is possible to reduce a temperature which is transmitted from the discharge space to the sealing member during a lighting operation because of construction with the cylindrical narrow tube, so that it is easy to prevent erosion of the sealing member due to a chemical reaction between the sealing member and the filled material in the discharge tube. Furthermore, it is possible to reduce thermal stress at a sealing portion of the sealing member and the cylindrical narrow tube caused by a heat cycle created by repeated lighting condition and extinguished condition, and it is possible to increase the reliability compared with a configuration of a conventional sealed part.

It will be recognized that some or all of the Figures are schematic representations for purposes of illustration and do not necessarily depict the actual relative sizes or locations of the elements shown.

DETAILED DESCRIPTION OF THE INVENTION

Hereafter, preferred embodiments of the present invention will be described with reference to the accompanying drawings.

<<FIRST EMBODIMENT>>

Figure 1:
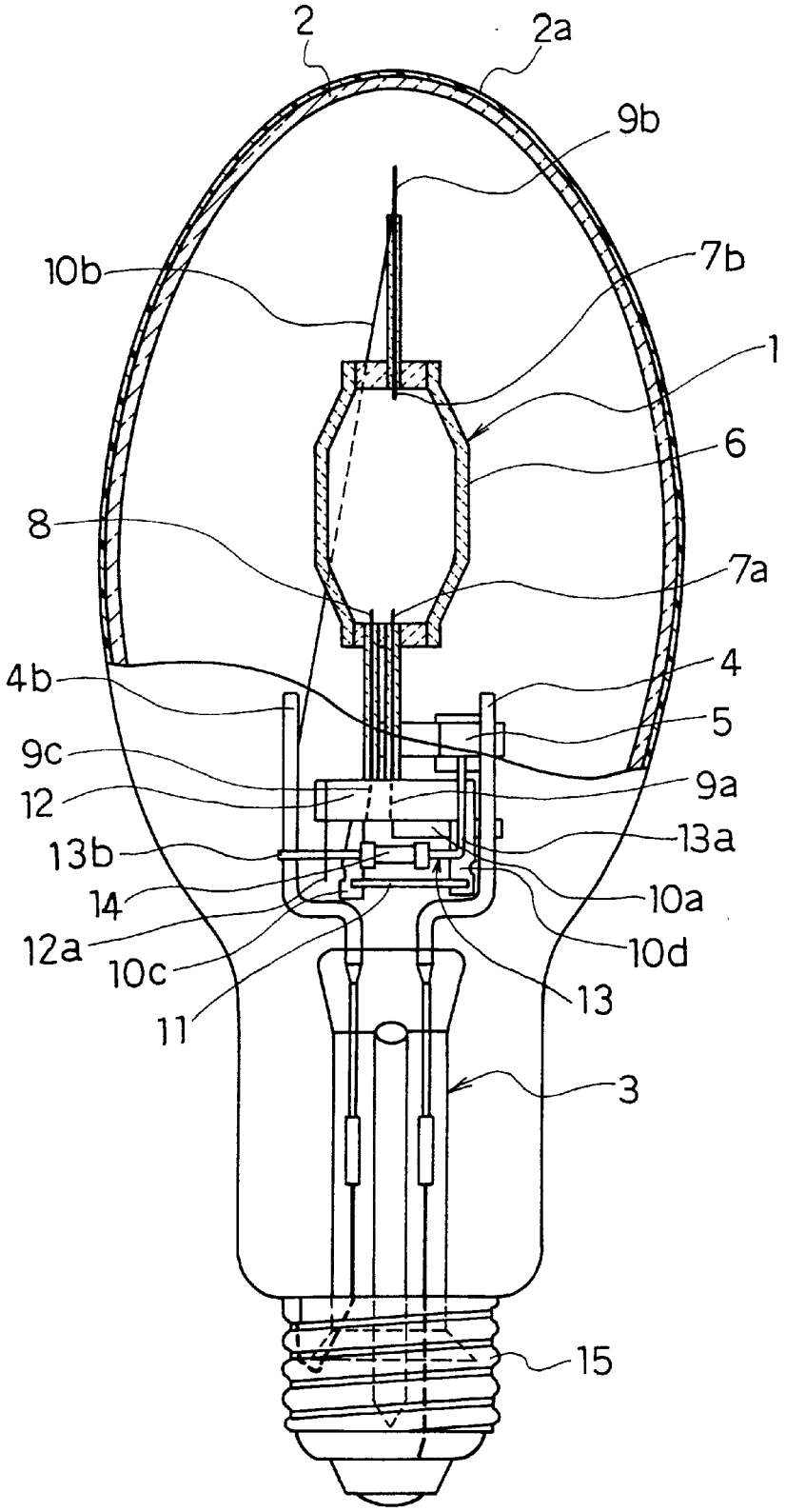
FIG. 1 is a partially cross-sectional view showing a configuration of a high-pressure metal vapor discharge lamp in a first embodiment of the present invention.

FIG. 1 is a partially cross-sectional view showing a configuration of a high-pressure metal vapor discharge lamp in a first embodiment of the present invention.

In FIG. 1, a high-pressure metal vapor discharge lamp has a rated lamp power of 100 W in which a discharge tube 1 made of a ceramic material having a transparent or translucent is contained in an outer tube 2.

A stem insulator 3 is disposed at one end portion of the outer tube 2, so that the outer tube 2 is sealed by the stem insulator 3 airtightly. Lead-through-support-wires 4*a*, 4*b* are disposed adjacent to each other to the stem insulator 3, and the discharge tube 1 is supported by a discharge tube support plate 5 mounted to the lead-through-support-wire 4*a*. Further, in order to protect from burning at damage of the outer tube 2, an external surface of the outer tube 2 is coated with a fluorocarbon resin film 2*a*. A mixture of Ne-gas and $N_2$-gas is filled in the outer tube 2.

A first main electrode 7*a* and a second main electrode 7*b* are disposed to the both end parts of the discharge tube 1, respectively, so that the first and the second main electrodes 7*a*, 7*b* are disposed inside a main tube 6 for forming a discharge space. On the first main electrode 7*a*, an auxiliary electrode 8 is disposed inside the main tube 6 in a proper distance away from the first main electrode 7*a*. Concretely, the distance between the first main electrode 7*a* and the auxiliary electrode 8 is in a range between 1 mm and 2 mm, for instance. Furthermore, mercury having a predetermined amount, a rare gas for a start of a lighting operation and a luminescent material such as a metal halide are filled into the discharge tube 1.

The first main electrode 7*a* is connected to one end of an outer lead-through-wire 9*a*. The other end of the outer lead-through-wire 9*a* is connected to a connecting member 10*a* fixed to the lead-through-support-wire 4*a*. Thereby, current is supplied to the first main electrode 7*a* through the lead-through-support-wire 4*a*, the connecting member 10*a* and the outer lead-through-wire 9*a* in that order. Similarly, the second main electrode 7*b* is connected to one end of an outer lead-through-wire 9*b*. The other end of the outer lead-through-wire 9*b* is connected to a connecting member 10*b* fixed to the lead-through-support-wire 4*b*. Thereby, current is supplied to the second main electrode 7*b* through the lead-through-support-wire 4*b*, the connecting member 10*b* and the outer lead-through-wire 9*b* in that order.

The auxiliary electrode 8 is connected to one end of an outer lead-through-wire 9*c*. The other end of the outer lead-through-wire 9*c* is connected to one end of a connecting member 10*c*. The other end of the connecting member 10*c* is connected to one end of a current-limiting resistor 11. The other end of the current-limiting resistor 11 is connected to one end part of a bimetal 12, which is a thermally-actuated element having a bimetal pin 12*a* at a tip portion of the other end part, through a connecting m ember 10*d*.

The one end part of the bimetal 12 is also connected to one end part 13*a* of a bimetal support wire 13, and the bimetal pin 12*a* is connected to the other end part 13*b* of the bimetal support wire 13. The bimetal support wire 13 has an insulator 14 at the central portion thereof, so that the both end parts 13*a*, 13*b* of the bimetal support wire 13 are electrically insulated from each other by the insulator 14. Furthermore, the one end part 13*a* of the bimetal support wire 13 is fixed by the discharge tube support plate 5 which is electrically insulated.

The other end part 13*b* of the bimetal support wire 13 is connected to the lead-through-support-wire 4*b*. The bimetal pin 12*a* is separable from the other end part 13*b* of the bimetal support wire 13 so that the bimetal 12 is connected with and/or disconnected from the lead-through-support-wire 4*b* electrically.

In accordance with the above-mentioned construction, current is supplied to the auxiliary electrode 8 through the lead-through-support-wire 4*b*, the other end part 13*b* of the bimetal support wire 13, the bimetal pin 12*a*, the bimetal 12, the connecting member 10*d*, the current-limiting resistor 11, the connecting member 10*c*, and the outer lead-through-wire 9*c* in that order.

In the lighting operation of the high-pressure metal vapor discharge lamp, an auxiliary discharge is generated between the first main electrode 7*a* and the auxiliary electrode 8 firstly, and thereafter the auxiliary discharge is induced to a main discharge generated between the first main electrode 7*a* and the second electrode 7*b*. After keeping to the main discharge, the bimetal 12 operates, the bimetal pin 12*a* detach from the other end part 13*b* of the bimetal support wire 13 connected to the lead-through-support-wire 4*b*. Thereby supply of the current to the auxiliary electrode 8 is stopped.

A base 15 is disposed to one end portion of the outer tube 2, so that the current is supplied to the lead-through-support-wires 4*a*, 4*b* from a lighting circuit or the like (not shown) which is disposed outside.

Next, a configuration of the discharge tube 1 in the first embodiment will be explained with reference to FIGS. 2 and 3 specifically.

Figure 2:
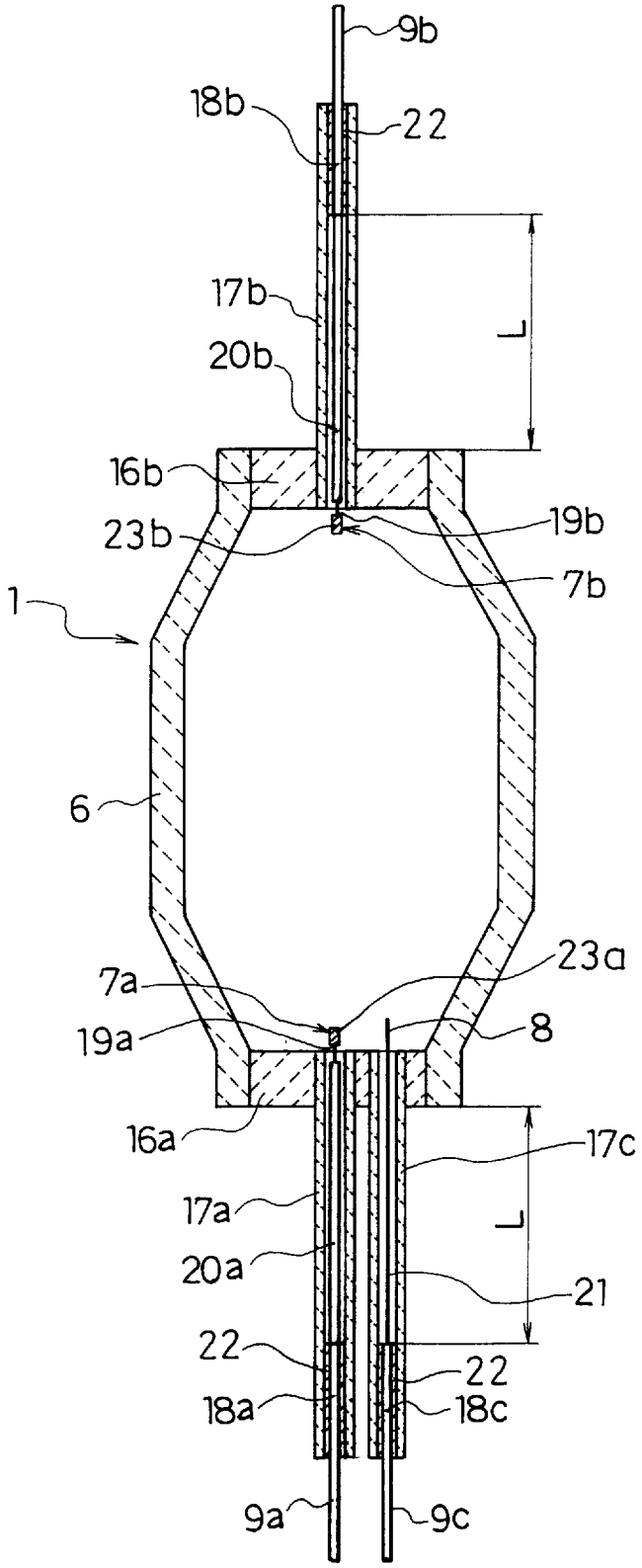
FIG. 2 is an expanded cross-sectional view showing a configuration of a discharge tube shown in FIG. 1.

FIG. 2 is an expanded cross-sectional view showing a configuration of a discharge tube shown in FIG. 1. FIG. 3 is an expanded cross-sectional view showing a configuration of a cylindrical narrow tube shown in FIG. 1.

In FIG. 2, the discharge tube 1 comprises the substantially cylindrical main tube 6, and first and second disks 16*a* and 16*b* disposed at openings of the both ends of the main tube 6, respectively. The main tube 6 and the first and the second disks 16*a* and 16*b* are made of the translucent ceramic material in which alumina is contained as a main ingredient. The first and the second disks 16*a* and 16*b* are integrated and fixed to the main tube 6 by a shrinkage fitting, so that the main tube 6 is sealed airtightly. One end portions of cylindrical narrow tubes 17*a*, 17*c* are integrated with the first disk 16*a* by the shrinkage fitting. In a similar manner, one end portion of a cylindrical narrow tube 17*b* is integrated with the second disk 16*b* by the shrinkage fitting.

Figure 3:
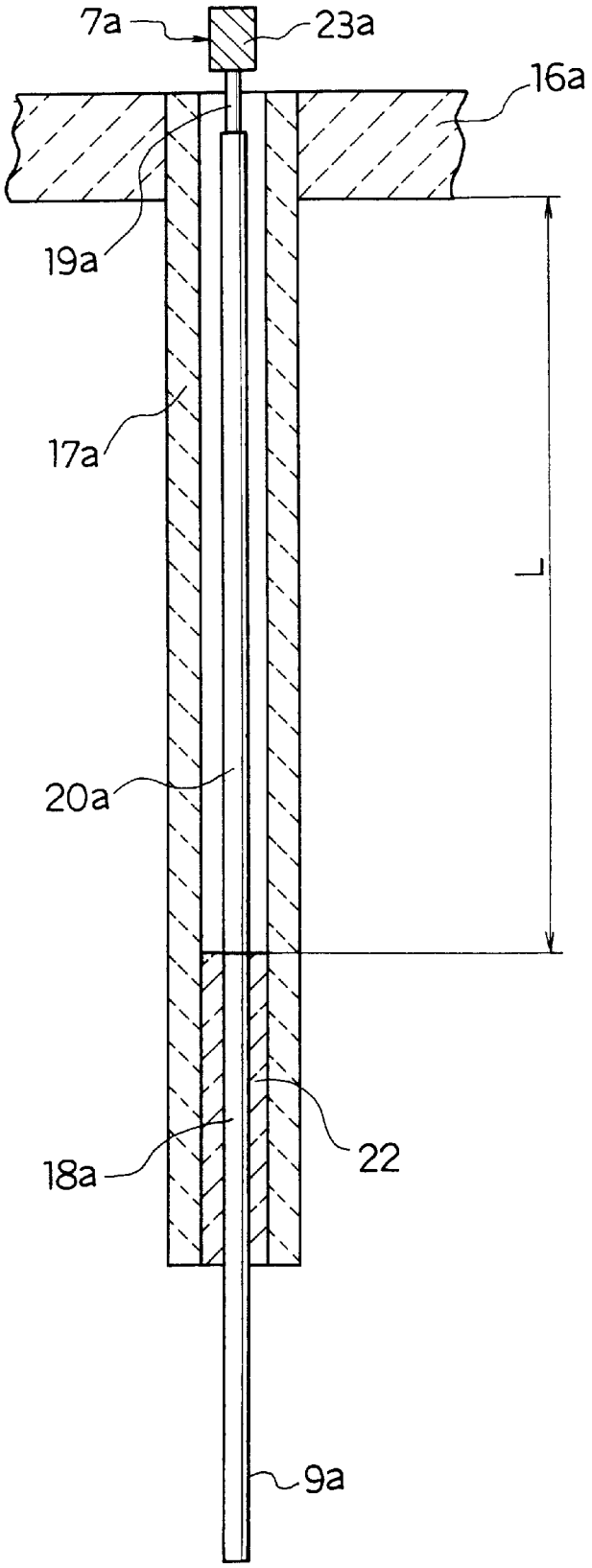
FIG. 3 is an expanded cross-sectional view showing a configuration of a cylindrical narrow tube shown in FIG. 1.

As shown in FIG. 3, a conductive sealing member 18*a*, a first lead-through-wire 20*a* and a first main electrode shaft 19*a* are integrated and inserted in the cylindrical narrow tube 17*a*. Specifically, one end of the first lead-through-wire 20*a* is connected with one end of the sealing member 18*a* by a welding, and the other end of the first lead-through-wire 20*a* is connected with one end of the first main electrode shaft 19*a* by the welding. Then, the sealing member 18*a* is fixed to the inner surface of the cylindrical narrow tube 17*a* by a frit 22 in a manner that the cylindrical narrow tube 17*a* is sealed airtightly. When the sealing member 18*a*, the first lead-through-wire 20*a* and the first main electrode shaft 19*a* are disposed in the cylindrical narrow tube 17*a*, the other end part of the sealing member 18*a* is led outside the cylindrical narrow tube 17*a*, and serves as the outer lead-through-wire 9*a*.

Furthermore, an electrode coil 23*a* is integrated and mounted to a tip portion of the other end of the first main electrode shaft 19*a* by the welding, so that the first main electrode 7*a* is configured by the first main electrode shaft 19*a* and the electrode coil 23*a*. The first lead-through-wire 20*a* serves as a lead-through-part for disposing the first main electrode 7*a* at a predetermined position in the main tube 6 (FIG. 2). The sealing member 18*a* is formed by a metal wire of niobium. For example, diameter of the sealing member 18*a* is 0.9 mm, and diameter of the first main electrode shaft 19*a* is 0.5 mm.

Similarly, in FIG. 2, a conductive sealing member 18*b*, a second lead-through-wire 20*b* and a second main electrode shaft 19*b* are integrated and inserted in the cylindrical narrow tube 17*b*. Specifically, one end of the second lead-through-wire 20*b* is connected with one end of the sealing member 18*b* by the welding, and the other end of the second lead-through-wire 20*b* is connected with one end of the second main electrode shaft 19*b* by the welding. Then, the sealing member 18*b* is fixed to the inner surface of the cylindrical narrow tube 17*b* by the frit 22 in a manner that the cylindrical narrow tube 17*b* is sealed airtightly. When the sealing member 18*b*, the second lead-through-wire 20*b* and the second main electrode shaft 19*b* are disposed in the cylindrical narrow tube 17*b*, the other end part of the sealing member 18*b* is led outside the cylindrical narrow tube 17*b*, and serves as the outer lead-through-wire 9*b*.

Furthermore, an electrode coil 23*b* is integrated and mounted to a tip portion of the other end of the second main electrode shaft 19*b* by the welding, so that the second main electrode 7*b* is configured by the second main electrode shaft 19*b* and the electrode coil 23*b*. The second lead-through-wire 20*b* serves as a lead-through-part for disposing the second main electrode 7*b* at a predetermined position in the main tube 6. The sealing member 18*b* is formed by the metal wire of niobium. For example, diameter of the sealing member 18*b* is 0.9 mm, and diameter of the second main electrode shaft 19*b* is 0.5 mm.

Similarly, in FIG. 2, a conductive sealing member 18*c* and an auxiliary electrode shaft 21 are integrated and inserted in the cylindrical narrow tube 17*c*. Specifically, one end of the auxiliary electrode shaft 21 is connected with one end of the sealing member 18*c* by the welding. Then, the sealing member 18*c* is fixed to the inner surface of the cylindrical narrow tube 17*c* by the frit 22 in a manner that the cylindrical narrow tube 17*c* is sealed airtightly. When the sealing member 18*c* and the auxiliary electrode shaft 21 are disposed in the cylindrical narrow tube 17*c*, the other end part of the sealing member 18*c* is led outside the cylindrical narrow tube 17*c*, and serves as the outer lead-through-wire 9*c*. The auxiliary electrode 8 is mounted to the other end part of the auxiliary electrode shaft 21. The auxiliary electrode shaft 21 serves as a lead-through-part for disposing the auxiliary electrode 8 at a predetermined position in the main tube 6. The sealing member 18*c* is formed by the metal wire of niobium. For example, diameter of the sealing member 18*c* is 0.9 mm, and diameter of the auxiliary electrode shaft 21 is 0.3 mm.

Subsequently, a leakage test of the discharge tube 1 carried out by the present inventors will be explained. In this leakage test, the discharge tube 1 was attached to the high-pressure metal vapor discharge lamp of 100 W shown in FIG. 1, and examined to find whether a leakage of the discharge tube 1 occurred during 3,000 hours of a test operation with the cycle including lightings each for 5.5 hours and continuous extinguishing each for 0.5 hour.

Furthermore, in the leakage test, six types of the discharge tubes 1 each having different distance "L" of FIGS. 2 and 3 were prepared and tested. The distance "L" is equal to a length between an outermost surface of the main tube 6 and each ends of the sealing members 18*a*, 18*b*, 18*c* in the respective cylindrical narrow tubes 17*a*, 17*b*, 17*c*. In the distance "L", the six types of the discharge tubes 1 were adjusted to 1.0, 1.5, 2.3, 3.5, 4.0, and 4.8 mm, respectively. In the six types of the discharge tubes 1, the maximum outer diameter of the main tube 6 was adjusted to 11 mm, each outer diameters of the cylindrical narrow tubes 17*a*, 17*b* was adjusted to 2.8 mm. Further, outer diameter of the cylindrical narrow tube 17*c* was adjusted to 2.1 mm, and each outer diameters of the sealing members 18*a*, 18*b*, 18*c* made of the niobium was adjusted to 0.9 mm. The mercury having the predetermined amount was filled into the respective discharge tube 1, and a mixture of Ne-gas and Ar-gas was filled into the respective discharge tube 1 as the start of the lighting operation. Moreover, in the respective discharge tube 1, sodium iodide, tantalum iodide, indium iodide and lithium iodide were filled as the metal halide of the luminescent material. In the outer tube 2, the mixture of Ne-gas and $N_2$-gas was filled.

Furthermore, in the leakage test, the six types of the discharge tubes 1 were tested, and a number of a test sample in which the leakage was occurred was counted. Thereby, occurrence rate of the leakage was obtained every the six types of the discharge tubes 1.

Test results of the leakage test are shown in Table 1.

TABLE 1

| Distance "L" | Occurrence rate of the leakage |
|---|---|
| 1.0 mm | 44% |
| 1.5 mm | 34% |
| 2.3 mm | 16% |
| 3.5 mm | 2% |
| 4.0 mm | 0% |
| 4.8 mm | 0% |

As clearly shown in Table 1, when the distance "L" was adjusted to 4.0 mm or more, there was no occurrence of the leakage of the discharge tube 1. That is, it was found that the leakage of the discharge tube 1 could be prevented by adjusting the distance "L" to 4.0 mm or more. According to the present inventors' consideration, the reason why is that thermal shock caused by the repeat of the lighting condition and the extinguished condition can be reduced by adjusting the distance "L" to 4.0 mm or more, so that temperatures at the respective sealing members 18*a*, 18*b*, 18*c* and the respective cylindrical narrow tubes 17*a*, 17*b*, 17*c* become low during the lighting condition. As a result, it is possible to avoid destroy of the cylindrical narrow tubes 17*a*, 17*b*, 17*c* caused by the respective sealing members 18*a*, 18*b*, 18*c*, and to prevent the leakage of the discharge tube 1.

In the aforementioned explanation, while the sealing members 18*a*, 18*b*, 18*c* are made of niobium, the sealing members 18*a*, 18*b*, 18*c* may be made of either one of tantalum, platinum and rhenium.

Figure 12:
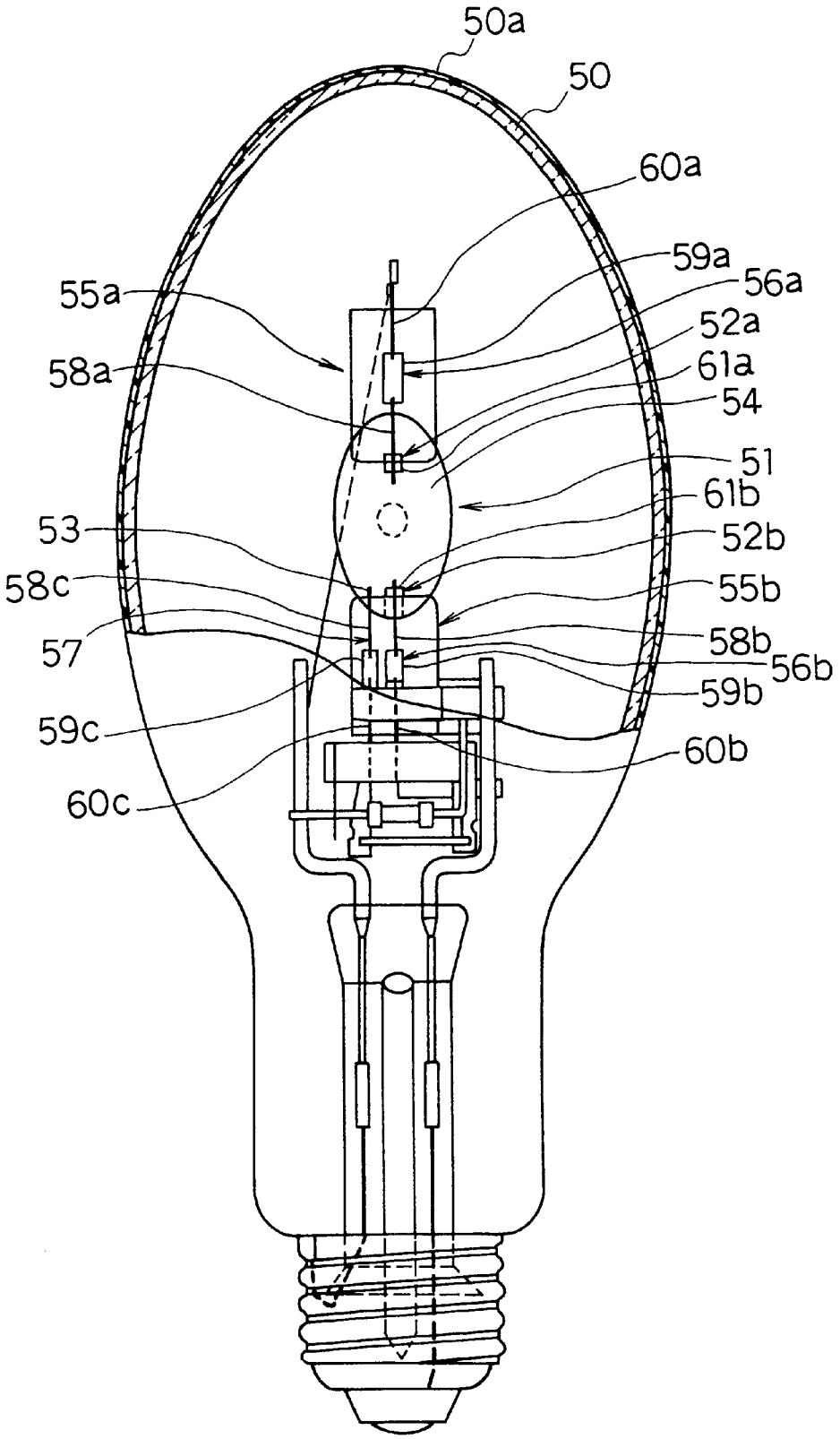
FIG. 12 (Prior Art)
FIG. 12 is a partially cross-sectional view showing a configuration of a conventional high-pressure metal vapor discharge lamp.

Furthermore, according to the present inventors' comparison tests, it was confirmed that lamp characteristics of the high-pressure metal vapor discharge lamp were improved in comparison with those of the conventional high-pressure metal vapor discharge lamp. In the comparison tests, the high-pressure metal vapor discharge lamp of the present invention in which the above-mentioned distance "L" was adjusted to 4.0 mm was prepared as an embodiment example. Further, the high-pressure metal vapor discharge lamp equipped with the discharge tube made of the quartz glass shown in FIG. 12 was prepared as a comparison example.

In the comparison tests, the embodiment example and the comparison example were operated in a 6,000 hours of a test operation with the cycle including lightings each for 5 hours and continuous extinguishing each for 0.5 hour. Hereafter, in the embodiment example and the comparison example, a maintenance rate of luminous flux and quantity of change in a color temperature were examined. Test results of the lamp characteristics are shown in Table 2.

TABLE 2

| | Maintenance rate of luminous flux | Quantity of change in a color temperature |
|---|---|---|
| Embodiment example | 83% | −155 K |
| Comparison example | 65% | −450 K |

As clearly shown in Table 2, the maintenance rate of luminous flux of the embodiment example was higher than that of the comparison example. Further, in the embodiment example, the quantity of change in the color temperature was smaller than that of the comparison example. That is, the lamp characteristics of the embodiment example were stable during the lifetime and improved than those of the comparison example.

As has been explained in the above, in the high-pressure metal vapor discharge lamp embodying the present invention, the discharge tube 1 is made of the ceramic material having the translucent property, and comprises the substantially cylindrical main tube 6, and the first and the second disks 16*a* and 16*b* disposed at openings of the both ends of the main tube 6, respectively. Further, in order to dispose the first main electrode 7*a* inside the main tube 6, one end of the cylindrical narrow tube 17*a* made of the ceramic material is fixed to the first disk 16*a*, and the first lead-through-wire 20*a* and the sealing member 18*a* are inserted in the cylindrical narrow tube 17*a*. Similarly, in order to dispose the second main electrode 7*b* inside the main tube 6, one end of the cylindrical narrow tube 17*b* made of the ceramic material is fixed to the second disk 16*b*, and the second lead-through-wire 20*b* and the sealing member 18*b* are inserted in the cylindrical narrow tube 17*b*. Similarly, in order to dispose the auxiliary electrode 8 inside the main tube 6, one end of the cylindrical narrow tube 17*c* made of the ceramic material is fixed to the first disk 16*a*, and the auxiliary electrode shaft 21 and the sealing member 18*c* are inserted in the cylindrical narrow tube 17*c*. Thus, in the high-pressure metal vapor discharge lamp of the first embodiment, the discharge tube 1 is formed and sealed without a known pinch seal method using in the comparison example. Thereby, it is possible to always form the discharge tube 1 into a constant shape. This prevents deviations in the shape of the discharge tube 1 and hence deviations in the lamp characteristics due to the deviations in the shape of the discharge tube 1. Furthermore, the sealing members 18*a*, 18*b*, 18*c* are fixed to the respective inner surfaces of the cylindrical narrow tubes 17*a*, 17*b*, 17*c* by the frit 22 in a manner that the distance "L" between the outermost surface of the main tube 6 and each ends of the sealing members 18*a*, 18*b*, 18*c* is adjusted to 4.0 mm or more. Thereby, it is possible to prevent the leakage of the discharge tube 1. Further, it is possible to obtain a better and more stable lamp characteristics during the lifetime of the lamp than those of the comparison example equipped with the discharge tube made of quartz glass.

<<SECOND EMBODIMENT>>

Figure 4:
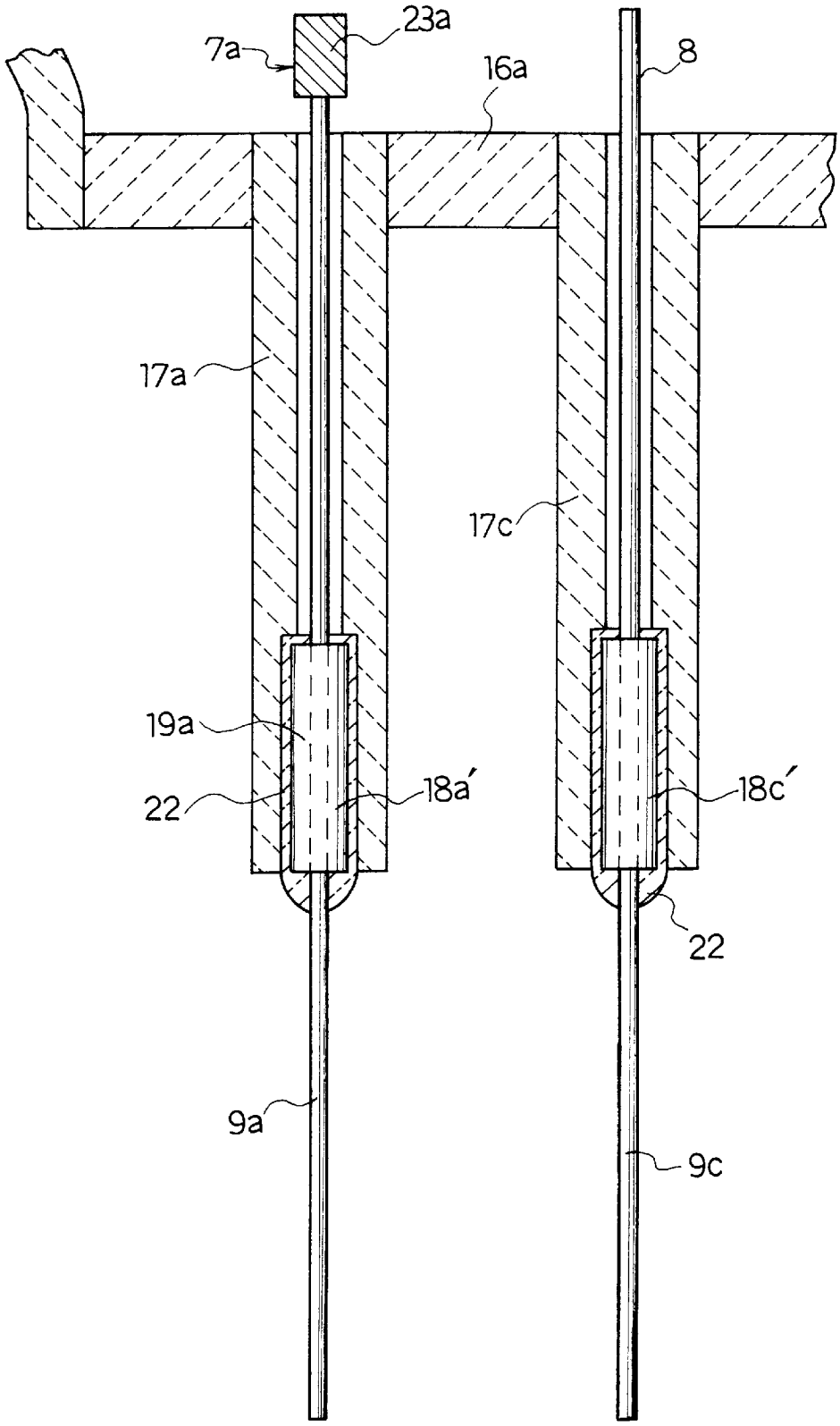
FIG. 4 is an expanded cross-sectional view showing a configuration of a cylindrical narrow tube of a discharge tube of a high-pressure metal vapor discharge lamp in a second embodiment of the present invention.

FIG. 4 is an expanded cross-sectional view showing a configuration of a cylindrical narrow tube of a discharge tube of a high-pressure metal vapor discharge lamp in a second embodiment of the present invention. According to the configuration of the high-pressure metal vapor discharge lamp of this second embodiment, the first and the second main electrode shafts penetrate the sealing members without connecting the first and the second lead-through-wires, respectively. Furthermore, the auxiliary electrode penetrates the sealing member. The other elements and portions are similar to those of the first embodiment and will not be described.

As shown in FIG. 4, the first main electrode shaft 19*a* penetrates a sealing member 18*a*'. In a similar manner to the first embodiment, the electrode coil 23*a* is mounted to a tip portion of one end of the first main electrode shaft 19*a* by welding, so that the first main electrode 7*a* is configured by the first main electrode shaft 19*a* and the electrode coil 23*a*. After the first main electrode shaft 19*a*, the sealing member 18*a*' and the electrode coil 23*a* are integrated, the sealing member 18*a*' is fixed to the inner surface of the cylindrical narrow tube 17*a* by the frit 22 in a manner that the cylindrical narrow tube 17*a* is sealed airtightly. When the first main electrode shaft 19*a* and the sealing member 18*a*' are disposed in the cylindrical narrow tube 17*a*, one end part of the first main electrode shaft 19*a* is led outside the cylindrical narrow tube 17*a*, namely, outside the discharge tube 1, so that the one end part of the first main electrode shaft 19*a* serves as the outer lead-through-wire 9*a*. Similarly, in the cylindrical narrow tube 17*b*, the second main electrode shaft 19*b* penetrates a sealing member 18*b*' (not shown). Further, as shown in FIG. 4, a sealing member 18*c*' is penetrated by and integrated with the auxiliary electrode 8. The sealing member 18*c*' is fixed to the inner surface of the cylindrical narrow tube 17*c* by the frit 22 in a manner that the cylindrical narrow tube 17*c* is sealed airtightly. When the auxiliary electrode 8 and the sealing member 18*c*' are disposed in the cylindrical narrow tube 17*c*, one end part of the auxiliary electrode 8 is led outside the cylindrical narrow tube 17*c*, so that the one end part of the auxiliary electrode 8 serves as the outer lead-through-wire 9*c*.

In this second embodiment, each of the sealing members 18*a*', 18*b*', 18*c*' is made of alumina containing tungsten. Further, each of the sealing members 18*a*', 18*b*', 18*c*' may be made of alumina containing molybdenum.

Apart from the aforementioned explanation, wherein the sealing members 18*a*', 18*b*', 18*c* ' are fixed to the inner surfaces of the cylindrical narrow tubes 17*a*, 17*b*, 17*c* by the frit 22, respectively, an alternately construction may be such that the sealing members 18*a*', 18*b*', 18*c* ' are fixed to the inner surfaces of the cylindrical narrow tubes 17*a*, 17*b*, 17*c* by the shrinkage fitting, respectively.

In the aforementioned explanation, the first and the second main electrode shafts 19*a*, 19*b* penetrate the sealing members 18*a*', 18*b*', respectively. However, an alternately construction may be such that the electrodes 23*a*, 23*b* are mounted to one ends of the first and the second lead-through-wires 20*a*, 20*b*, and the first and the second lead-through-wires 20*a*, 20*b* penetrate the sealing members 18*a*', 18*b*' without using the first and the second main electrode shafts 19*a*, 19*b*, respectively.

<<THIRD EMBODIMENT>>

Figure 5:
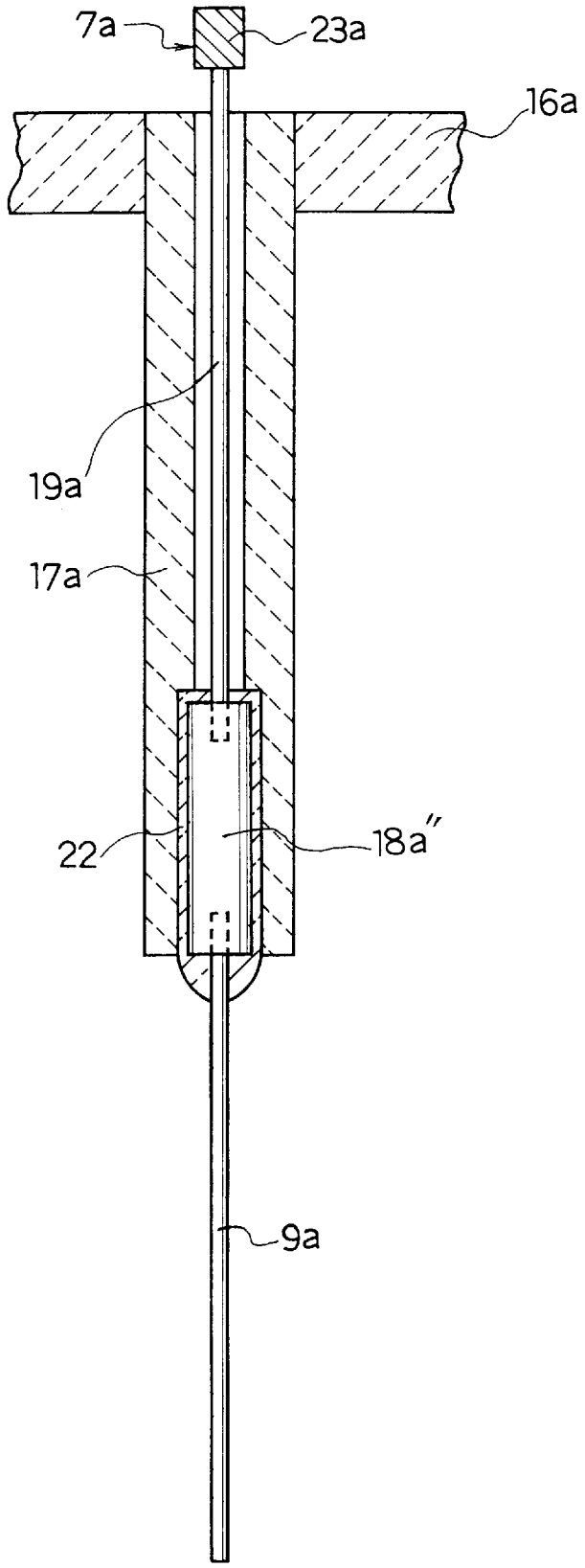
FIG. 5 is an expanded cross-sectional view showing a configuration of a cylindrical narrow tube of a discharge tube of a high-pressure metal vapor discharge lamp in a third embodiment of the present invention.

FIG. 5 is an expanded cross-sectional view showing a configuration of a cylindrical narrow tube of a discharge tube of a high-pressure metal vapor discharge lamp in a third embodiment of the present invention. According to the configuration of the high-pressure metal vapor discharge lamp of this third embodiment, a sealing member is made of a conductive ceramic, and disposed between the main electrode shaft and the outer lead-through-wire so that the sealing member serves as the lead-through-part. The other elements and portions are similar to those of the first embodiment and will not be described.

In FIG. 5, a sealing member 18*a*" is made of a conductive ceramic such as alumina containing tungsten. The sealing member 18*a*" is disposed between the first main electrode shaft 19*a* and the outer lead-through-wire 9*a* in a manner that the outer lead-through-wire 9*a* is not directly connected to the first main electrode shaft 19*a* equipped with the first main electrode 7*a* at a tip portion. Specifically, as shown in FIG. 5, one end part of the outer lead-through-wire 9*a* is buried and connected to one end part of the sealing member 18*a*", and one end part of the first main electrode shaft 19*a* is buried and connected to the other end part of the sealing member 18*a*". In a similar manner to the first embodiment, the electrode coil 23*a* is mounted to the tip portion of the other end part of the first main electrode shaft 19*a*, so that the first main electrode 7*a* is configured by the first main electrode shaft 19*a* and the electrode coil 23*a*. After integrating the electrode coil 23*a*, the first main electrode shaft 19*a*, the sealing member 18*a*" and the outer lead-through-wire 9*a*, the sealing member 18*a*" is fixed to the inner surface of the cylindrical narrow tube 17*a* by the frit 22 in a manner that the cylindrical narrow tube 17*a* is sealed airtightly. Further, such a configuration for disposing the first main electrode 7*a* in the main tube 6 (FIG. 2) may be used for the second main electrode 7*b* in the cylindrical narrow tube 17*b*.

In the above-mentioned explanation, although the sealing member 18*a*" is made of alumina containing tungsten, the sealing member 18*a*" may be made of alumina containing molybdenum.

Electric power is supplied to the first main electrode shaft 19*a* from the outer lead-through-wire 9*a* through the sealing member 18*a*" made of the conductive ceramic.

Figure 6:
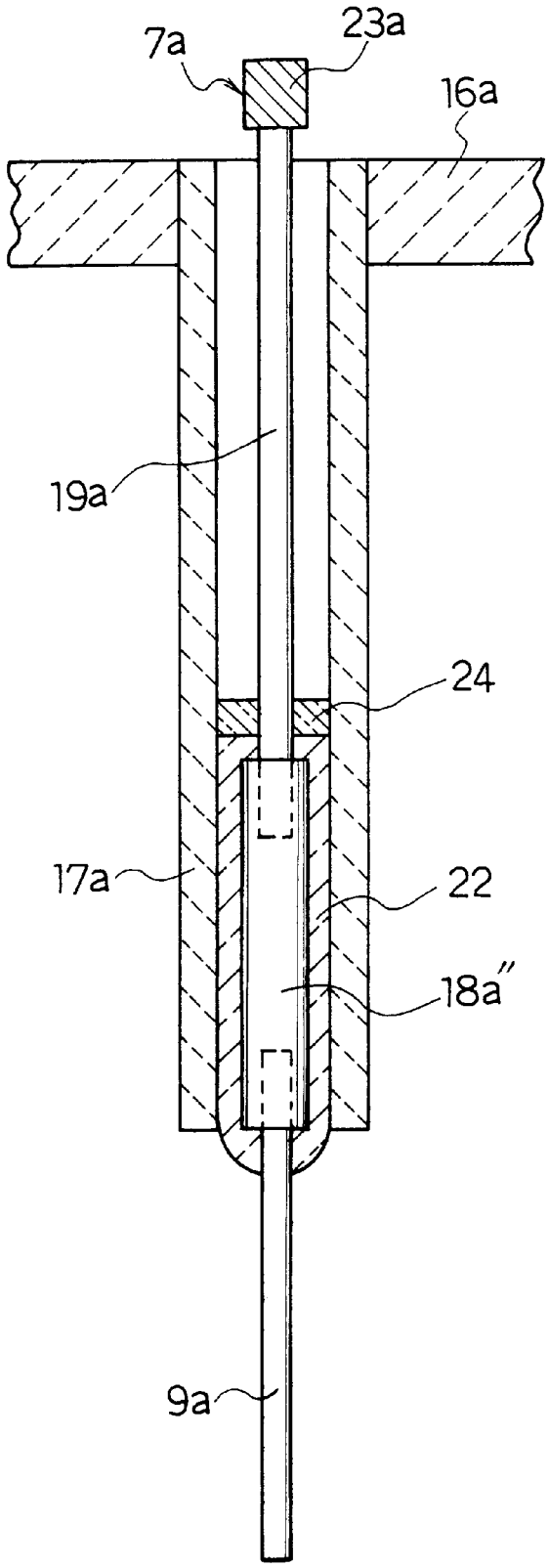
FIG. 6 is an expanded cross-sectional view showing a configuration of a modified version of the cylindrical narrow tube shown in FIG. 5.

Furthermore, as shown in FIG. 6, in order to prevent a chemical reaction between the sealing member 18*a*" and the iodinated substance intruding into the cylindrical narrow tube 17*a* from the main tube 6, a protection layer 24, which is made of the same material as that of the main tube 6, may be formed on the end surface on the first main electrode shaft 19*a* side of the sealing member 18*a*". Further, although the sealing member 18*a*" is fixed to the inner surface of the cylindrical narrow tube 17*a* by the frit 22, the sealing member 18*a*" may be fixed to the inner surface of the cylindrical narrow tube 17*a* by the shrinkage fitting. Moreover, in the aforementioned explanation, the first main electrode 7*a* is disposed in the main tube 6 without using the first lead-through-wire 20*a*. However, the first lead-through-wire 20*a* is connected between the sealing member 18*a*" and the first main electrode shaft 19*a* equipped with the electrode coil 23*a* at the tip portion, so that the first main electrode 7*a* may be disposed in the main tube 6. This may be used as the configuration in the cylindrical narrow tube 17*b*.

<<FOURTH EMBODIMENT>>

Figure 7:
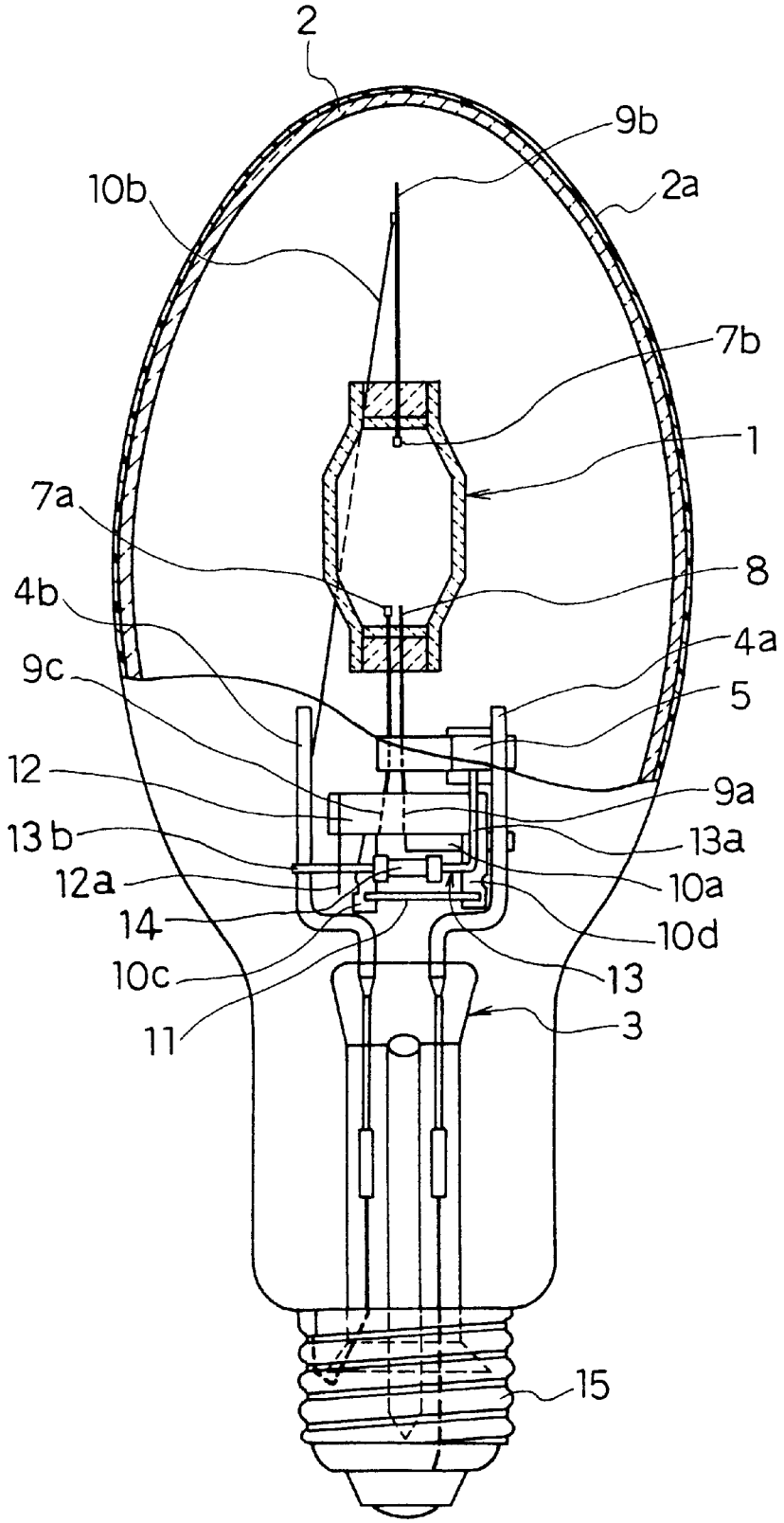
FIG. 7 is a partially cross-sectional view showing a configuration of a high-pressure metal vapor discharge lamp in a fourth embodiment of the present invention.
Figure 8:
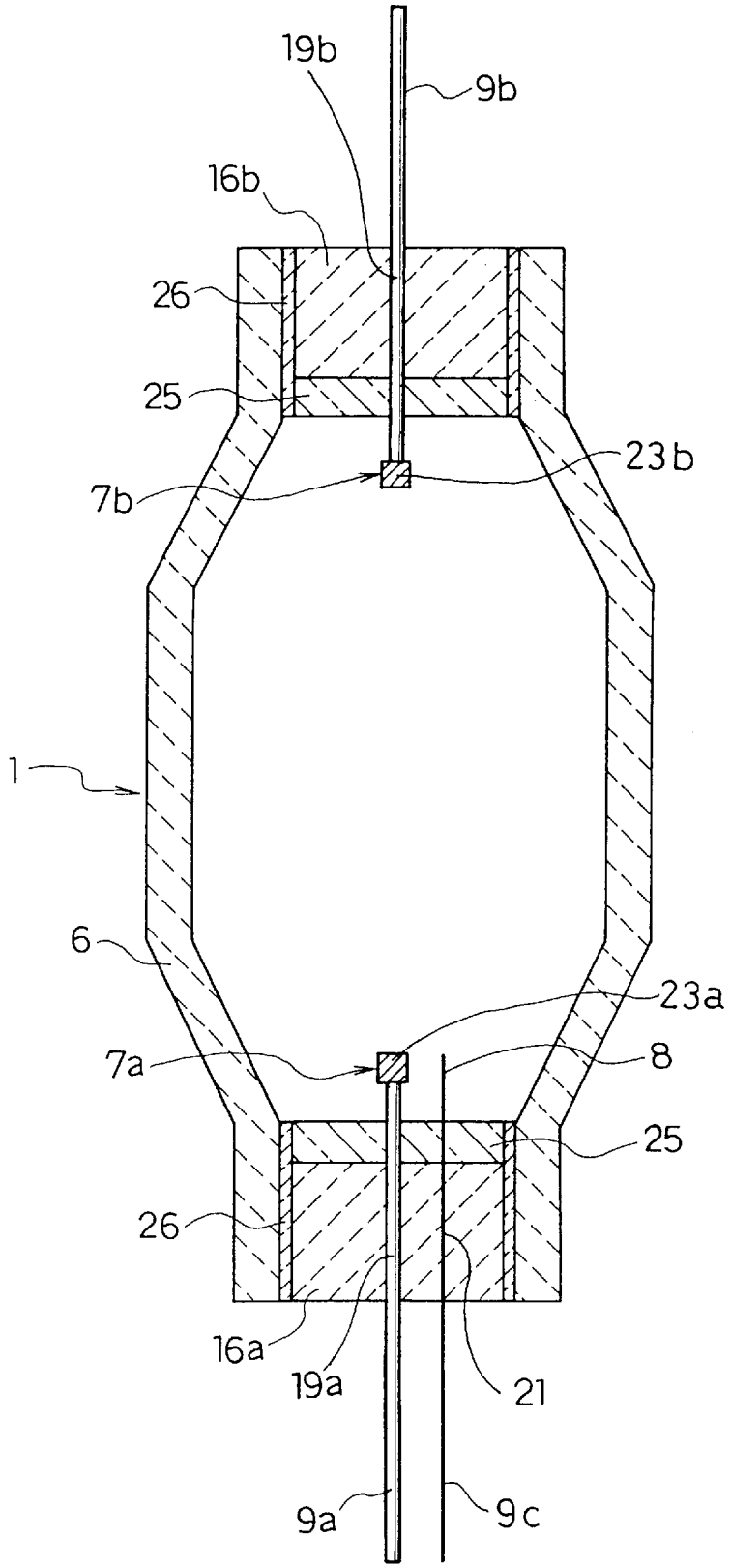
FIG. 8 is an expanded cross-sectional view showing a configuration of a discharge tube shown in FIG. 7.

FIG. 7 is a partially cross-sectional view showing a configuration of a high-pressure metal vapor discharge lamp in a fourth embodiment of the present invention. FIG. 8 is an expanded cross-sectional view showing a configuration of a discharge tube shown in FIG. 7. According to the configuration of the high-pressure metal vapor discharge lamp of this fourth embodiment, the first and the second disks are airtightly sealed and integrated with the openings of the both ends of the main tube mainly-made of alumina by a frit. Furthermore, protection layers, which are made of the same material as that of the main tube, are mounted on surfaces of the first and the second disks in the main tube. Moreover, the first main and the auxiliary electrode shafts are directly fixed to the first disk without the cylindrical narrow tubes, and the second main electrode shaft is directly fixed to the second disk without the cylindrical narrow tube. The other elements and portions are similar to those of the first embodiment and will not be described.

In FIGS. 7 and 8, the first and the second disks 16*a*, 16*b* are made of an insulating ceramic such as alumina containing a very small amount of tungsten. The first and the second disks 16*a*, 16*b* are fixed to the respective openings of the both ends of the cylindrical main tube 6 by a frit 26 in a manner that the main tube 6 is sealed airtightly. Furthermore, in the main tube 6, protection layers 25, which is made of the same material as that of the main tube 6, are mounted on surfaces of the first and the second disks 16*a*, 16*b*.

As shown in FIG. 8, the electrode coils 23*a*, 23*b* are mounted to the tip portions on the main tube 6 side of the first and the second main electrode shafts 19*a*, 19*b* made of tungsten, respectively, so that the first and the second main electrodes 7*a*, 7*b* are formed in the main tube 6. The first and the second main electrode shafts 19*a*, 19*b* penetrate the first and the second disks 16*a*, 16*b*, and are airtightly sealed to the first and the second disks 16*a*, 16*b* by shrinkage fitting, respectively. Similarly, the auxiliary electrode shaft 21 penetrates the first disk 16*a* and is airtightly sealed through the first disk 16*a* by the shrinkage fitting. When the first disk 16*a* is mounted to the main tube 6, one end parts of the first main electrode shaft 19*a* and the auxiliary electrode shaft 21 are disposed outside the main tube 6, so that the one end parts of the first main electrode shaft 19*a* and the auxiliary electrode shaft 21 serve as the outer lead-through-wires 9*a*, 9*c*, respectively. Similarly, when the second disk 16*b* is mounted to the main tube 6, one end parts of the second main electrode shaft 19*b* is disposed outside the main tube 6, so that the one end part of the second main electrode shaft 19*b* serves as the outer lead-through-wire 9*b*.

By the above-mentioned configuration, in the high-pressure metal vapor discharge lamp of this embodiment, it is possible to obtain a stable lamp characteristic and excellent lifetime characteristic which have been heretofore unobtainable with the conventional high-pressure metal vapor discharge lamp equipped with the discharge tube made of quartz glass as achieved in that of the first embodiment. Furthermore, since the first and the second main electrode shafts 19*a*, 19*b* are not airtightly sealed to the first disk 16*a* by the frit, the leakage of the discharge tube 1 and a chemical reaction between the frit and the filled metal can be avoided. The first and the second disks 16*a*, 16*b* may be airtightly sealed to the main tube 6 by the shrinkage fitting without using the frit 26.

<<FIFTH EMBODIMENT>>

Figure 9:
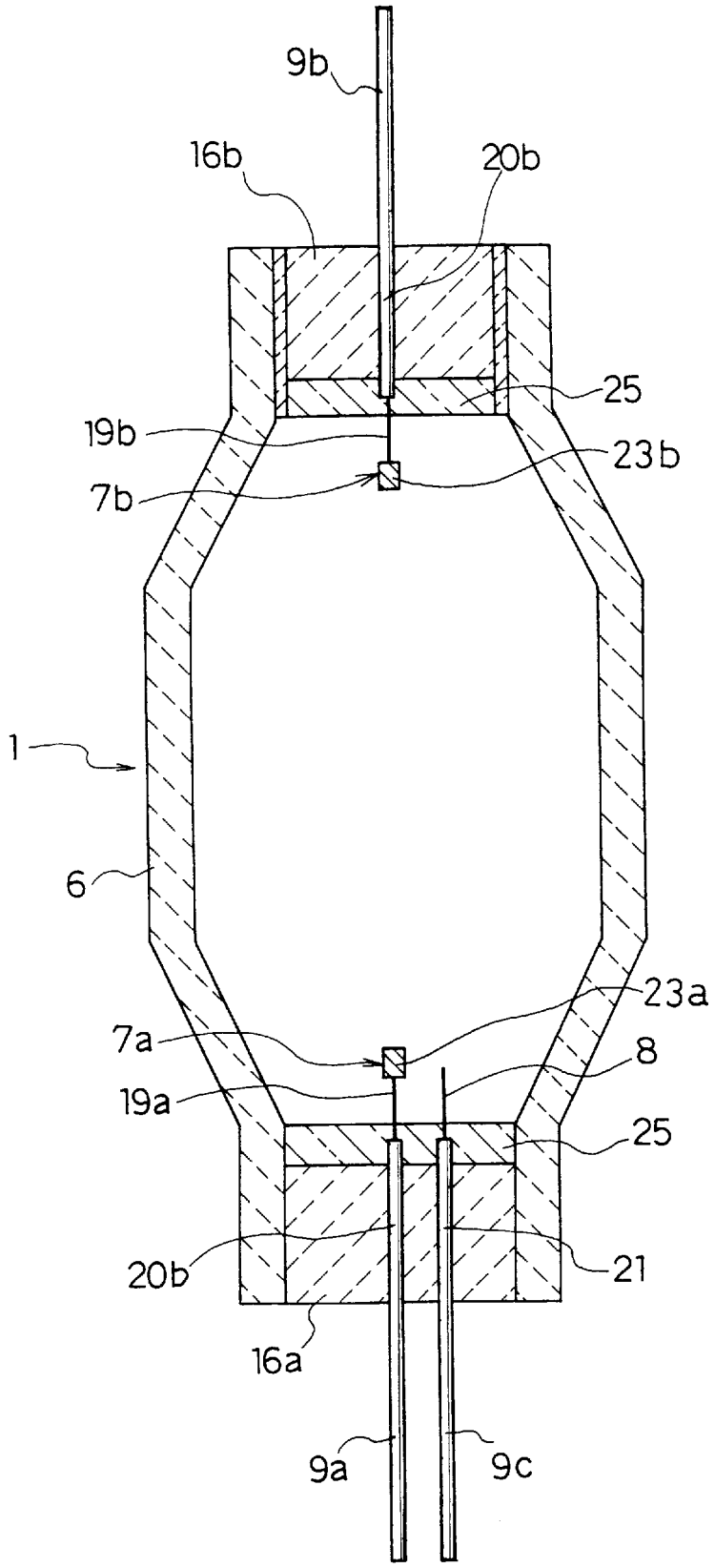
FIG. 9 is an expanded cross-sectional view showing a configuration of a discharge tube of a high-pressure metal vapor discharge lamp in a fifth embodiment of the present invention.

FIG. 9 is an expanded cross-sectional view showing a configuration of a discharge tube of a high-pressure metal vapor discharge lamp in a fifth embodiment of the present invention. According to the configuration of the high-pressure metal vapor discharge lamp of this fifth embodiment, the first lead-through-wire and the auxiliary electrode shaft penetrate the first disk, and the second lead-through-wire penetrates the second disk. Furthermore, the first and the second main electrode shafts are connected to one end parts of the first and the second lead-through-wires, respectively, in a manner that the first and the second main electrodes are disposed in the main tube. The auxiliary electrode is connected to one end part of the auxiliary electrode shaft in the main tube. The other elements and portions are similar to those of the fourth embodiment and will not be described.

In FIG. 9, the first and the second disks 16*a*, 16*b* are made of the insulating ceramic such as alumina containing a very small amount of tungsten. The first disk 16*a* is fixed to one opening of the main tube 6 by the shrinkage fitting, and the second disk 16*b* is fixed to the other opening of the main tube 6 by the frit 26. The first and the second lead-through-wires 20*a*, 20*b* made of molybdenum penetrate the first and the second disks 16*a*, 16*b*, respectively. The first and the second lead-through-wires 20*a*, 20*b* are fixed to the first and the second disks 16*a*, 16*b* by the shrinkage fitting, respectively. In the main tube 6, one ends of the first and the second lead-through-wires 20*a*, 20*b* are connected to one ends of the first and the second main electrode shafts 19*a*, 19*b*, respectively. Furthermore, in the main tube 6, the electrode coils 23*a*, 23*b* are mounted to tip portions of the other ends of the first and the second main electrode shafts 19*a*, 19*b*, so that the first and the second main electrodes 7*a*, 7*b* are configured, respectively. The other end parts of the first and the second lead-through-wires 20*a*, 20*b* are led outside the first and the second disks 16*a*, 16*b*, so as to serve as the outer lead-through-wires 9*a*, 9*b*, respectively.

The auxiliary electrode shaft 21 penetrates the first disk 16*a*, and the auxiliary electrode shaft 21 is fixed to the first disk 16*a* by the shrinkage fitting. In the main tube 6, one end of the auxiliary electrode shaft 21 is connected to one end of the auxiliary electrode 8. The other end part of the auxiliary electrode shaft 21 is led outside the first disk 16*a*, so as to serve as the outer lead-through-wire 9*c*.

In this embodiment, it is preferable that the protection layers 25 are formed on the surfaces of the main tube 6 side of the first and the second disks 16*a*, 16*b* in a manner to cover the respective connecting points between the first and the second main electrode shafts 19*a*, 19*b* and the first and the second lead-through-wires 20*a*, 20*b*.

By the above-mentioned configuration, the high-pressure metal vapor discharge lamp of this embodiment obtains a similar effect to those of the respective embodiments described above.

<<SIXTH EMBODIMENT>>

Figure 10:
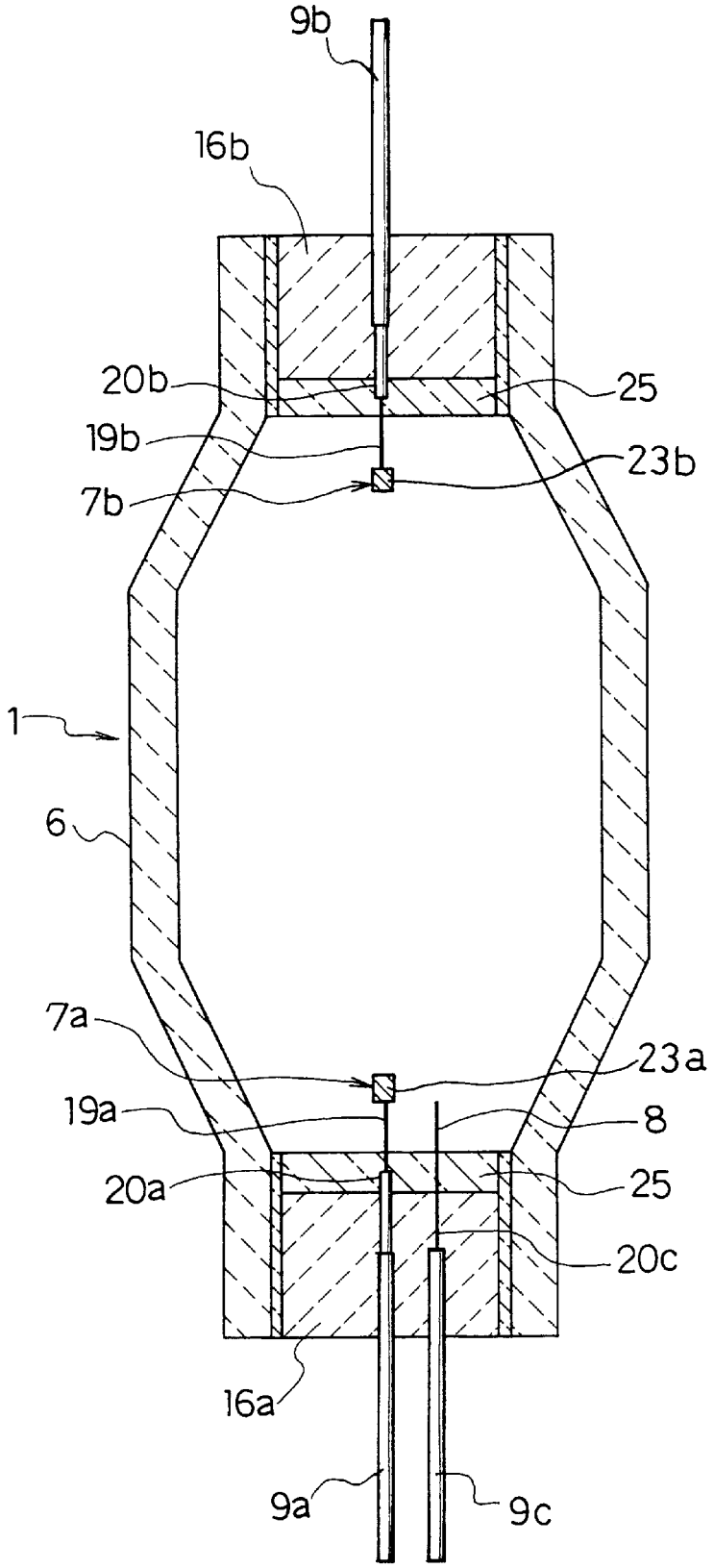
FIG. 10 is an expanded cross-sectional view showing a configuration of a discharge tube of a high-pressure metal vapor discharge lamp in a sixth embodiment of the present invention.

FIG. 10 is an expanded cross-sectional view showing a configuration of a discharge tube of a high-pressure metal vapor discharge lamp in a sixth embodiment of the present invention. According to the configuration of the high-pressure metal vapor discharge lamp of this sixth embodiment, the outer lead-through-wire is connected to the lead-through-wire, and a connecting point between the outer lead-through-wire and the lead-through-wire is disposed in the disk, so that the outer lead-through-wire is served as the sealing member a like niobium wire for sealing the discharge tube in the disks. The other elements and portions are similar to those of the fourth embodiment and will not be described.

In FIG. 10, the outer lead-through-wires 9*a*, 9*b* are connected to one ends of the first and the second lead-through-wires 20*a*, 20*b* by the welding, respectively. The outer lead-through-wires 9*a*, 9*b* are made of the niobium. A welding point between the outer lead-through-wire 9*a* and the first lead-through-wire 20*a* is located in the first disk 16*a*. Similarly, a welding point between the outer lead-through-wire 9*b* and the second lead-through-wire 20*b* is located in the second disk 16*b*. The other ends of the first and the second lead-through-wires 20*a*, 20*b* are connected to one ends of the first and the second main electrode shafts 19*a*, 19*b* by the welding, respectively. The electrode coils 23*a*, 23*b* are mounted to the tip portions of the other ends of the first and the second main electrode shafts 19*a*, 19*b*, respectively, so that the first and the second main electrodes 7*a*, 7*b* are configured in the main tube 6. Thus, the outer lead-through-wire 9*a* and the first lead-through-wire 20*a* serve as the first lead-through-part for disposing the first main electrode 7*a* at the predetermined position in the main tube 6. Similarly, the outer lead-through-wire 9*b* and the second lead-through-wire 20*b* serve as the second lead-through-part for disposing the second main electrode 7*b* at the predetermined position in the main tube 6.

The outer lead-through-wire 9*c* is connected to one end of the auxiliary lead-through-wire 20*c* by the welding. The outer lead-through-wire 9*c* is also made of the niobium. A welding point between the outer lead-through-wire 9*c* and the auxiliary lead-through-wire 20*c* is located in the first disk 16*a*. The auxiliary electrode 8 is mounted to the other end of the auxiliary lead-through-wire 20*c* in the main tube 6. Thus, the outer lead-through-wire 9*c* and the auxiliary lead-through-wire 20*c* serve as the auxiliary lead-through-part for disposing the auxiliary electrode 8 at the predetermined position in the main tube 6.

In this embodiment, the outer lead-through-wires 9*a*, 9*b*, 9*c* are made of the niobium having a similar coefficient of expansion to the first and the second disks 16*a*, 16*b*. Further, the outer lead-through-wires 9*a*, 9*c* are fixed to the first disk 16*a* by the shrinkage fitting so as to embed in the first disk 16*a* with a predetermined length. Similarly, the outer lead-through-wire 9*b* is fixed to the second disk 16*b* by the shrinkage fitting so as to embed in the second disk 16*b* with the predetermined length. Thereby, the outer lead-through-wires 9*a*, 9*b*, 9*c* serve as the sealing member to seal the discharge tube 1, so that the sealing members 18*a*, 18*b*, 18*c* shown in FIG. 2 are omitted.

A part from the aforementioned explanation, wherein the outer lead-through-wires 9*a*, 9*b*, 9*c* are made of the niobium, an alternately construction may be such that the outer lead-through-wires 9*a*, 9*b*, 9*c* are made either one of tantalum, platinum and rhenium. Further, the first and the second lead-through-wires 20*a*, 20*b* may be used as the first and the second main electrode shafts 19*a*, 19*b*, respectively. That is, one ends of the first and the second lead-through-wires 20*a*, 20*b* are directly connected to the electrode coils 23*a*, 23*b* without the first and the second main electrode shafts 19*a*, 19*b*, so that the first and the second lead-through-parts are configured, respectively.

<<SEVENTH EMBODIMENT>>

Figure 11:
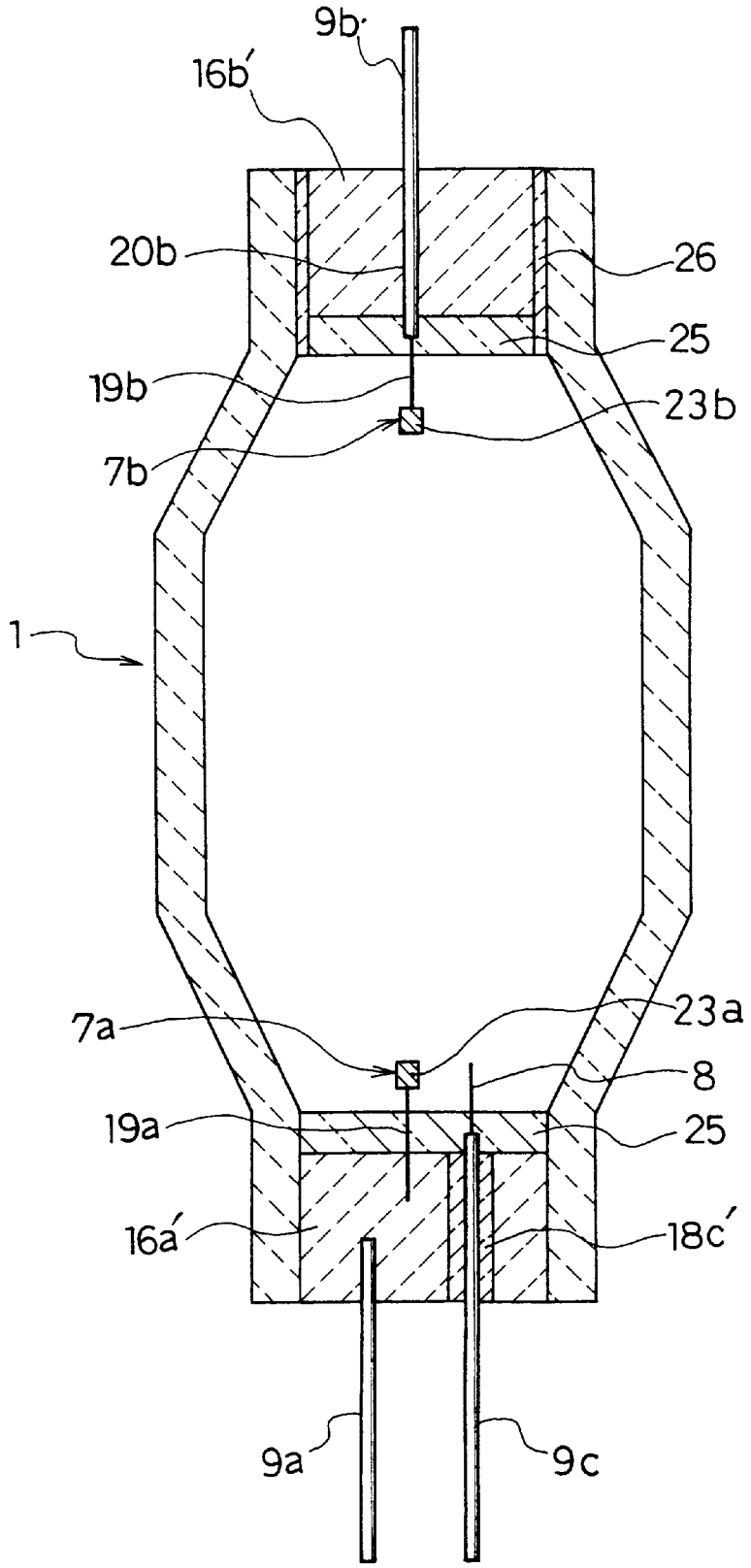
FIG. 11 is an expanded cross-sectional view showing a configuration of a discharge tube of a high-pressure metal vapor discharge lamp in a seventh embodiment of the present invention.

FIG. 11 is an expanded cross-sectional view showing a configuration of a discharge tube of a high-pressure metal vapor discharge lamp in a seventh embodiment of the present invention. According to the configuration of the high-pressure metal vapor discharge lamp of this seventh embodiment, the first and the second disks are made of the conductive ceramic. The other elements and portions are similar to those of the fourth embodiment and will not be described.

In FIG. 11, the first and the second disks 16*a*, 16*b* are made of the conductive ceramic. One end of the first main electrode shaft 19*a* is mounted to the electrode coil 23*a*, so that the first main electrode 7*a* is configured in the main tube 6. The other end of the first main electrode shaft 19*a* is embedded in the first disk 16*a*. One end of the outer lead-through-wire 9*a* is embedded in the first disk 16*a* with a predetermined distance of 1.5 to 3.0 mm, for example, from the other end of the first main electrode shaft 19*a*. In this embodiment, electric power is supplied to the first main electrode shaft 19*a* from the outer lead-through-wire 9*a* through the first disk 16*a*.

One end of the second main electrode shaft 19*b* is mounted to the electrode coil 23*b*, so that the second main electrode 7*b* is configured in the main tube 6. The other end of the second main electrode shaft 19*b* is connected to one end of the second lead-through-wire 20*b*. When the second lead-through-wire 20*b* is fixed to the second disk 16*b* by the shrinkage fitting, the other end part of the second lead-through-wire 20*b* is led outside the second disk 16*b*, and serves as the outer lead-through-wire 9*b*.

The auxiliary electrode 8 is fixed to the tip portion of the outer lead-through-wire 9*c* by the welding. This outer lead-through-wire 9*c* penetrates the sealing member 18*c*' made of the insulating ceramic, and is sealed through the sealing member 18*c*' by the shrinkage fitting. Furthermore, the sealing member 18*c*' is fixed and sealed to the first disk 16*a* so that the auxiliary electrode 8 is located inside the discharge space of the main tube 6. After the auxiliary electrode 8, the outer lead-through-wire 9*c* and the sealing member 18*c*' are integrated with each other, the auxiliary electrode 8, the outer lead-through-wire 9*c* and the sealing member 18*c*' are mounted to the first disk 16*a*. The first disk 16*a* is airtightly fixed to the main tube 6 by the shrinkage fitting, and the second disk 16*b* is airtightly fixed to the main tube 6 by the frit 26. Moreover, the protection layers 25, which is made of the same material as that of the main tube 6, are formed on the end surfaces on the discharge space side of the first and the second disks 16*a*, 16*b*.

In the respective embodiments, a similar effect is obtained even when electrodes coating with an emitter having a property of emission of electron.

As has been described in the above, in the high-pressure metal vapor discharge lamps according to the respective embodiments of the present invention, the auxiliary discharge is firstly started between the first main electrode 7*a* and the auxiliary electrode 8 after supplying the electric power, and the main discharge between the main electrodes 7*a*, 7*b* smoothly takes over and a stable discharge state is maintained. In the high-pressure metal vapor discharge lamp of the present invention, unlike the conventional discharge tube made of the quartz glass, it is possible to reduce deviations in the shape of the discharge tube 1 by forming with the ceramic material, and hence, reduce deviations in the lamp characteristics caused by the deviations in the shape. Furthermore, since the ceramic material which has a small reactivity with the filled iodinated materials is used, it is possible to obtain the high-pressure metal vapor discharge lamp which is highly efficient and shows a stable lifetime characteristic independently of whether gas exists in the outer tube 2 nor the composition of gas therein.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

We claim:

1. A high-pressure metal vapor discharge lamp comprising:

a discharge tube made of a ceramic material having a transparent or translucent property, said discharge tube containing at least a luminescent material, and said discharge tube having a main tube, a first disk disposed at one opening of said main tube, and a second disk disposed at a second opening of said main tube, a plurality of cylindrical narrow tubes made of a ceramic material, said cylindrical narrow tubes being mounted to said first and second disks, a plurality of a lead-through-parts disposing a pair of main electrodes and an auxiliary electrode in said main tube, a sealing member integrated with each of said lead-through-parts, said sealing member being inserted in each said cylindrical narrow tube so that each said cylindrical narrow tube is sealed airtightly, and said auxiliary electrode being disposed inside said main tube a predetermined distance away from one of said main electrodes.

2. The high-pressure metal vapor discharge lamp in accordance with claim 1, wherein a distance between an outermost surface of said main tube and an end of said sealing member in said cylindrical narrow tube is adjusted to 4.0 mm or more.

3. The high-pressure metal vapor discharge lamp in accordance with claim 1, wherein said lead-through-part penetrates said sealing member.

4. The high-pressure metal vapor discharge lamp in accordance with claim 1, wherein said sealing member is made of a conductive ceramic, and said lead-through-part is connected to one end of said sealing member in said cylindrical narrow tube.

5. The high-pressure metal vapor discharge lamp in accordance with claim 1, wherein said sealing member is sealed to said cylindrical narrow tube by either of a shrinkage fitting and a frit.

6. The high-pressure metal vapor discharge lamp in accordance with claim 1, wherein said lead-through-part is a main electrode shaft which holds a main electrode.

7. The high-pressure metal vapor discharge lamp in accordance with claim 1, wherein said lead-through-part is a lead-through-wire which holds a main electrode.

8. The high-pressure metal vapor discharge lamp in accordance with claim 1, wherein said lead-through-part is an auxiliary lead-through-wire which holds an auxiliary electrode.

9. The high-pressure metal vapor discharge lamp in accordance with claim 1, a discharge tube made of a ceramic material having a transparent or translucent property, said discharge tube containing at least a luminescent material, and said discharge tube having a main tube, a first disk disposed at one opening of said main tube, and a second disk disposed at the other opening of said main tube, first and second main electrodes disposed in said main tube, an auxiliary electrode disposed adjacent to one of said first and second main electrodes, a first main electrode shaft having said first main electrode mounted at a tip portion, said first main electrode shaft penetrating said first disk, and said first main electrode shaft sealed with said first disk airtightly, a second main electrode shaft having said second main electrode mounted at a tip portion, said second main electrode shaft penetrating said second disk, and said second main electrode shaft sealed with said second disk airtightly, and an auxiliary electrode shaft having said auxiliary electrode mounted at a tip portion, said auxiliary electrode shaft penetrating one of said first and second disks, and said auxiliary electrode shaft sealed with said one of said first and second disks airtightly.

10. The high-pressure metal vapor discharge lamp in accordance with claim 9, wherein a first lead-through-wire connected to said first main electrode shaft and an auxiliary lead-through-wire connected to said auxiliary electrode shaft are mounted to said first disk so that said first lead-through-wire is disposed adjacent to said auxiliary lead-through-wire, a second lead-through-wire connected to said second main electrode shaft is mounted to said second disk, said first lead-through-wire and said auxiliary lead-through-wire penetrate said first disk, and said first lead-through-wire and said auxiliary lead-through-wire are sealed with said first disk airtightly, and said second lead-through-wire penetrates said second disk, and said second lead-through-wire is sealed with said second disk airtightly.

11. The high-pressure metal vapor discharge lamp in accordance with claim 9, wherein a first outer lead-through-wire is connected to either of said first lead-through-wire and said first main electrode shaft in said first disk, a second outer lead-through-wire is connected to either of said auxiliary lead-through-wire or said auxiliary electrode shaft in said first disk, a third outer lead-through-wire is connected to either of said second lead-through-wire or said second main electrode shaft in said second disk, and each of said first, second, and third outer lead-through-wires is served as a sealing member for sealing said discharge tube.

12. The high-pressure metal vapor discharge lamp in accordance with claim 9, wherein at least one of said first and second disks is made of a conductive ceramic, and an outer lead-through-wire is mounted to said one of said first and second disks so that said outer lead-through-wire comes apart from either of said main electrode shaft and said lead-through-wire in said one of said first and second disks.

13. The high-pressure metal vapor discharge lamp in accordance with claim 1, wherein said sealing member is made of a metal which contains at least one of niobium, tantalum, platinum and rhenium.

14. The high-pressure metal vapor discharge lamp in accordance with claim 1, wherein said sealing member is mainly made of the same material as that of said cylindrical narrow tube and contains at least one of tungsten or molybdenum.

15. The high-pressure metal vapor discharge lamp in accordance with claim 9, wherein said first and second disks are mainly made of the same material as that of said main tube and contain at least one of tungsten or molybdenum.

16. A high-pressure metal vapor discharge lamp comprising:

a discharge tube made of a ceramic material having a transparent or translucent property, said discharge tube containing at least a luminescent material, and said discharge tube having a main tube;

a first disk disposed at one opening of said main tube;

a second disk disposed at a second opening of said main tube;

a plurality of cylindrical narrow tubes made of a ceramic material, said cylindrical narrow tubes being mounted to said first and second disks and disposed within said main tube;

a plurality of a lead-through-parts disposing a pair of main electrodes and an auxiliary electrode in said main tube with the respective cylindrical narrow tubes, one of the main electrodes and the auxiliary electrode being mounted to said first disk;

a sealing member integrated with each of said lead-through-parts, said sealing member being inserted in each said cylindrical narrow tube so that each said cylindrical narrow tube is sealed airtightly; and said auxiliary electrode being disposed inside said main tube in the range of about 1–2 mm away from said main electrode.

* * * * *